US008658270B2

(12) United States Patent
Böttger et al.

(10) Patent No.: US 8,658,270 B2
(45) Date of Patent: Feb. 25, 2014

(54) PENETRATION-INHIBITING MATERIAL

(75) Inventors: Christian Böttger, Remscheid (DE); Jutta Krabbe, Wuppertal (DE); Rüdiger Hartert, Wuppertal (DE)

(73) Assignee: Teijin Aramid GmbH, Wuppertal (DE)

( * ) Notice: Subject to any disclaimer, the term of this patent is extended or adjusted under 35 U.S.C. 154(b) by 402 days.

(21) Appl. No.: 13/126,903

(22) PCT Filed: Nov. 2, 2009

(86) PCT No.: PCT/EP2009/064446
§ 371 (c)(1),
(2), (4) Date: Apr. 29, 2011

(87) PCT Pub. No.: WO2010/052185
PCT Pub. Date: May 14, 2010

(65) Prior Publication Data

US 2011/0206893 A1 Aug. 25, 2011

(30) Foreign Application Priority Data

Nov. 7, 2008 (EP) ..... 08168603

(51) Int. Cl.
*B32B 5/12* (2006.01)

(52) U.S. Cl.
USPC ..... 428/107

(58) Field of Classification Search
USPC ..... 428/107, 105, 156, 213, 364; 139/383 R; 429/144
See application file for complete search history.

(56) References Cited

U.S. PATENT DOCUMENTS

| | | | | |
|---|---|---|---|---|
| 5,788,907 | A | 8/1998 | Brown, Jr. et al. | |
| 2004/0096708 | A1 * | 5/2004 | Bottger et al. | 428/911 |
| 2012/0137865 | A1 | 6/2012 | Citterio et al. | |

FOREIGN PATENT DOCUMENTS

| | | | |
|---|---|---|---|
| EP | 0 265 550 | A1 | 5/1988 |
| WO | WO 01/78975 | A1 | 10/2001 |

(Continued)

OTHER PUBLICATIONS

May 19, 2011 International Preliminary Report on Patentability issued in International Application No. PCT/EP2009/064446.

(Continued)

*Primary Examiner* — Brent O'Hern
(74) *Attorney, Agent, or Firm* — Oliff PLC

(57) ABSTRACT

A penetration-inhibiting material having a first component having a first layer with a first set of threads and a second layer with a second set of threads, wherein the first set of threads is oriented in a first thread direction and the second set of threads is oriented in a second thread direction, and the first thread direction is transverse to the second thread direction. The penetration-inhibiting material has a second component having a third layer and a fourth layer, wherein the third layer is a thread layer having a third set of threads and the fourth layer is a thread layer having a fourth set of threads, the third set of threads is oriented in a third thread direction and the fourth set of threads is oriented in a fourth thread direction, the third thread direction is transverse to the fourth thread direction, the third thread direction forms a first angle to the first thread direction and to the second thread direction, and the fourth thread direction forms a second angle to the first thread direction and to the second thread direction, the third set of threads and the fourth set of threads are joined to each other using at least a textile binding agent.

15 Claims, 4 Drawing Sheets

(56) References Cited

FOREIGN PATENT DOCUMENTS

| | | | |
|---|---|---|---|
| WO | WO 02/075238 | A1 | 9/2002 |
| WO | WO 2008/130391 | A2 | 10/2008 |

OTHER PUBLICATIONS

Feb. 3, 2010 International Search Report issued in International Application No. PCT/EP2009/064446 (with translation).

* cited by examiner

PENETRATION-INHIBITING MATERIAL

The invention relates to a penetration-inhibiting material.

Materials of this type are known. For example, written specification WO 02/075238 describes a penetration-inhibiting material with at least one double layer of a woven fabric. The woven layers have different types of fibers in the warp and weft directions. The two woven layers are arranged in the penetration-inhibiting material so that the same types of fiber run transversely to one another.

The object of the invention is to provide a penetration-inhibiting material that supplies good trauma values in addition to good penetration inhibiting characteristics.

The object is achieved by a penetration-inhibiting material which comprises at least one first component, wherein the first component has at least one first layer with a first set of threads and a second layer with a second set of threads, wherein the first set of threads is oriented in a first thread direction and the second set of threads is oriented in a second thread direction, wherein the first thread direction is transverse to the second thread direction, and wherein the penetration-inhibiting material has at least one second component, wherein the second component has at least one third layer and a fourth layer, wherein the third layer is a thread layer which has a third set of threads and the fourth layer is a thread layer which has a fourth set of threads, wherein the third set of threads is oriented in a third thread direction and the fourth set of threads is oriented in a fourth thread direction, and wherein the third thread direction is transverse to the fourth thread direction, wherein the third thread direction forms a first angle to the first thread direction and to the second thread direction, and the fourth thread direction forms a second angle to the first thread direction and to the second thread direction, and wherein the third set of threads and the fourth set of threads are joined to each other using at least one first binding agent, and wherein the first binding agent is a textile binding agent.

A penetration-inhibiting material is to be understood as a projectile-resistant and/or a stab-resistant material.

A thread direction that is transverse to another thread direction is to be understood to mean that the two thread directions form an angle of 70° to 110°, preferably 90° with each other.

A joining with a textile binding agent is to be understood to mean that the third layer and the fourth layer are joined with one another by, for example, Raschel knitting, interweaving, knitting and/or at least one thread (stitching, sewing).

The term "thread" should be understood as an elongated body whose longitudinal dimension is much larger than its transversal dimensions width and gauge. The term "thread" correspondingly also comprises fibers, wherein a thread can be formed from a plurality of fibers or only one fiber. The term "thread" comprises monofilaments, multifilaments, staple fibers, tapes, or strips, and other forms of chopped, cut or discontinuous fibers and similar forms with regular or irregular cross-sections. The term "fiber" in each case also comprises a plurality of the above mentioned objects or combinations thereof.

The first angle, which is formed by the first set of threads and the third set of threads, or by the second set of threads and the third set of threads, is preferably not less than ±10° and especially preferably not 0°. This means that the first set of threads preferably does not lie parallel to the third set of threads. It further means that the second set of threads does not lie parallel to the third set of threads.

It is further preferred that the second angle, which is formed by the first set of threads and the fourth set of threads, or respectively by the second set of threads and the fourth set of threads, is preferably not less than ±10° and especially preferably not 0°. This also means here that the first set of threads and the fourth set of threads, or respectively the second set of threads and the fourth set of threads, do not lie parallel to one another.

A thread layer is to be understood for example as a layer made from threads arranged unidirectionally to one another. The unidirectional threads within a layer therefore preferably lie essentially parallel to one another within the layer. A woven layer is not a thread layer within the meaning of the invention.

It is preferred that the third layer and the fourth layer, or respectively the third set of threads and the fourth set of threads, are joined with one another by at least one thread and especially preferably by at least one knitting thread.

Preferably the first set of threads and the second set of threads, or respectively the first layer and the second layer, are joined to one another by a second binding agent.

It is preferred that the second binding agent is at least one thread and/or an adhesive material.

It is further preferred that the first component and the second component are joined to one another by a third binding agent. The second layer and the third layer are joined to one another in an advantageous way by the third binding agent.

The third binding agent can preferably be an adhesive material. A possible embodiment of this type of adhesive material consists in that a film, an adhesive grid, an adhesive mesh, or similar structure can be used, wherein the adhesive can cover the whole surface or also only be at discrete points. An adhesive grid can consist for example of threads that are in contact with one another and made from fusible material or from threads that are coated with an adhesive. In another embodiment, the first component and the second component can be joined to one another by stitching or sewing.

Preferably the third set of threads and the fourth set of threads, thus preferably the third layer and the fourth layer, are also joined to one another with a fourth binding agent. The fourth binding agent is thus preferably an adhesive material. The joining of the third layer with the fourth layer is improved by the binding agent in an advantageous way.

It is preferred that a thermoplastic, or an elastomeric, or a duroplastic material is used as the adhesive material. It is understood that the penetration-inhibiting material can also consist of different adhesive materials.

It is further preferred that the threads that are used as the binding agent or as the textile binding agent can be so-called knitting threads. Such knitting threads can for example consist of threads with fibers with a low strength, wherein the threads can also have a low linear density. Preferably a polyester fiber, such as Trevira® 710 with a linear density of 140 dtex, is used for the knitting thread.

The first binding agent, as a textile binding agent, joins the third layer and the fourth layer to form a second component. It is preferred that the third layer and the fourth layer are additionally joined to one another using the fourth binding agent. The first binding agent and the fourth binding agent therefore function only in the third layer and the fourth layer. It is preferred that the first layer and the second layer are joined to one another to form a first component using the second binding agent. The second binding agent functions only in the first layer and the second layer. It is preferred that the first component and the second component are joined to one another using the third binding agent. The third binding agent consequently functions only between the first component and the second component, thus only between the second layer and the third layer.

It is preferred that the first layer has a fifth set of threads in addition to the first set of threads.

In one embodiment of the penetration-inhibiting material, the fifth set of threads is woven with the first set of threads. Preferably a woven fabric of this type has the first set of threads at 3.5 to 20 threads/cm, wherein the first set of threads accounts for approximately 65% of the weight of the woven layer, and forms the warp threads. The fifth set of threads can, for example, be present in the woven fabric at 0.5 to 16 threads/cm and form the weft threads. In a woven fabric of this type, the first set of threads can have a linear density of at least 200 dtex and the fifth set of threads can have a linear density of at least 50 dtex. Concerning the structure of a woven fabric of this type, reference is made to written specification WO 02/075238, which is hereby introduced as a reference.

In another embodiment of the penetration-inhibiting material, the fifth set of threads is also woven with the first set of threads; however, the fifth set of threads and the first set of threads are present in the woven fabric with approximately the same number of threads/cm and have the same linear density. The woven fabric can, for example, have a 1/1 plain weave, a mass per unit area of 200 g/m$^2$, a thread count of 10.5 threads/cm in the warp and weft directions, and consist of yarns with a linear density of 930 dtex, wherein the first set of threads forms the warp threads and the fifth set of threads forms the weft threads. Woven fabrics of this type are sold under the trade name Twaron® CT 709 by Teijin Aramid.

It is further preferred that the second layer has a sixth set of threads in addition to the second set of threads. The sixth set of threads is preferably woven with the second set of threads. It is preferred that the second set of threads can form the weft threads and the sixth set of threads can form the warp threads in a woven fabric made from the second set of threads and the sixth set of threads. Preferably, a woven fabric of this type has the second set of threads at 3.5 to 20 threads/cm, wherein the second set of threads accounts for approximately 65% of the weight of the woven layer. The sixth set of threads can be present in the woven fabric at 0.5 to 16 threads/cm, for example In a woven fabric of this type, the second set of threads can have a linear density of at least 200 dtex and the sixth set of threads can have a linear density of at least 50 dtex. Reference is made to specification WO 02/075238 concerning a woven fabric of this type.

Alternatively, a woven fabric, made from the second set of threads and the sixth set of threads, can have a structure like the woven fabric known by the trade name Twaron® CT 709.

It is preferred that the first set of threads, the second set of threads, the third set of threads, and the fourth set of threads are selected from aramid, polyethylene, polypropylene, and poly-p-phenylenebenzobisoaxazole (PBO) fibers.

It is further preferred that the fifth set of threads and the sixth set of threads are selected from fibers made from polyester, polyethylene, polypropylene, aramid, polyamide, glass, and poly-p-phenylenebenzobisoaxazole.

The cited sets of threads can also be selected from the aromatic polyester threads.

It is preferred that the first set of threads, the second set of threads, the third set of threads, and the fourth set of threads have threads with a linear density greater than 200 dtex, and the fifth set of threads and the sixth set of threads preferably have threads with a linear density greater than 50 dtex. It is preferred that the first set of threads, the second set of threads, the third set of threads, and the fourth set of threads have a linear density from 210 to 6720 dtex, more preferred between 420 and 3360 dtex, still more preferred between 420 and 1680 dtex and most preferred between approximately 840 and 1100 dtex. For the linear density of the fifth set of threads and the sixth set of threads, a value of at least approximately 50 dtex, more preferred between 50 and 280 dtex and most preferred between 80 and 140 dtex can be selected.

In another preferred embodiment, the first set of threads, the second set of threads, the third set of threads, the fourth set of threads, the fifth set of threads, and the sixth set of threads have threads with a linear density greater than 200 dtex. It is preferred that the linear density for these sets of threads lies between 210 and 6720 dtex, more preferred between 420 and 3360 dtex, still more preferred between 420 and 1680 dtex and most preferred between approximately 840 and 1100 dtex.

Preferably, the fifth set of threads is oriented in a fifth thread direction. It is preferred that the fifth thread direction is parallel to the second thread direction. It is further preferred that the fifth thread direction is transverse to the first thread direction.

It is preferred that the sixth set of threads is oriented in a sixth thread direction. The sixth thread direction is therefore preferably parallel to the first thread direction. It is further preferred that the sixth thread direction is transverse to the second thread direction.

In one embodiment, the first set of threads, the second set of threads, the third set of threads, and the fourth set of threads consist of aramid threads, and the fifth set of threads and the sixth set of threads preferably consist of polyester threads. It is particularly preferred that the aramid threads consist of para-aramid and especially of poly(paraphenylene terephthalamide).

It is further preferred that the first angle, which is formed by the third thread direction of the third set of threads and the first or the second thread direction of the respectively first or second set of threads, is ±30° to ±60°, especially ±45°.

It is preferred that the second angle, which is formed by the fourth thread direction of the fourth set of threads and the first or the second thread direction of the respectively first or second set of threads, is ±30° to ±60°, more particularly preferred ±45°.

In a particularly preferred embodiment of the invention, the penetration-inhibiting material has at least one double-layer woven fabric, wherein this double layer comprises a first layer that consists of a first set of threads at 3.5 to 20 threads/cm and a linear density of at least 210 dtex, and which first set of threads accounts for at least 65% of the weight of this woven layer, and a fifth set of threads at 0.5 to 16 threads/cm and a linear density of at least 50 dtex. The fifth set of threads preferably runs transversely to the first set of threads, and the ratio of the number of threads/cm of the first set of threads to the number of threads/cm of the fifth set of threads is >1. Further, the penetration-inhibiting material preferably comprises a second layer, which consists of a sixth set of threads at 0.5 to 16 threads/cm and a linear density of at least 50 dtex and of a second set of threads at 3.5 to 20 threads/cm and a linear density of at least 210 dtex, wherein the second set of threads accounts for at least 65% of the weight of this woven layer. The second set of threads of the second layer runs transversely to the sixth set of threads and the ratio of the number of threads/cm of the second set of threads to the number of threads/cm of the sixth set of threads is >1. The first set of threads of the first layer runs parallel to the sixth set of threads of the second layer and the second set of threads of the second layer runs parallel to the fifth set of threads of the first layer, wherein the penetration-inhibiting material has at least one third set of threads at 3.5 to 20 threads/cm and a linear density of at least 210 dtex in a third layer, and a fourth set of threads at 3.5 to 20 threads/cm and a linear density of at least 210 dtex in a fourth layer. The threads in the third layer are in a unidirectional, third thread direction parallel to one another, and the threads in the fourth layer are in a unidirectional, fourth thread direction parallel to one another. The third thread direction and the fourth thread direction are different, wherein the third thread direction is different from a first thread direction of the threads of the first set of threads of the first layer and from a second thread direction of the threads of the second set of threads of the second layer. In addition, the fourth thread direction is different from the first thread direction of the threads of the first set of threads of the first layer and from the second thread direction of the threads of the second set of threads of the second layer.

It is preferred in this embodiment that the first set of threads of the first layer as well as the sixth set of threads of the second layer are warp threads, and the fifth set of threads of the first layer as well as the second set of threads of the second layer are weft threads.

If the penetration-inhibiting material has as a first layer a woven layer made from a first set of threads and a fifth set of threads, and as a second layer a woven layer made from a second set of threads and a fifth set of threads, then it is preferred that the first layer has Twaron® in the warp direction and Trevira® in the weft direction. It is further preferred that the second layer has Twaron® in the weft direction and Trevira® in the warp direction.

A penetration-inhibiting material with two woven layers in the first component and a third layer and a fourth layer in the second component can be produced as follows:

A thermoplastic film made from polyethylene film (LDPE) with a thickness of 11 μm is laid between two layers (thread layers) (third layer and fourth layer) made from unidirectional Twaron® threads (type 2040, 930 dtex, f1000) arranged parallel to one another. The third layer and the fourth layer are aligned with one another such that a third thread direction of the third layer and a fourth thread direction of the fourth layer form an angle of 90°. The third layer, the fourth layer, and the film are joined to one another by means of knitting threads. The third set of threads and the fourth set of threads, or the third layer and the fourth layer respectively, can be stabilized by stabilizing threads. The stabilizing threads can thereby run parallel to a not-yet-present first thread direction (first layer). Twaron® threads (type 2040, 930 dtex, f1000) can for example be used as stabilizing threads. The third layer, the fourth layer, the thermoplastic film, the knitting threads, and the stabilizing threads form the second component.

The first component is formed in that two woven layers are laid on top of one another. The first woven layer (first layer) has Twaron® (type 2040, 930 dtex, f1000) in the warp direction and Trevira® (710, 140 dtex, Hoechst) in the weft direction. The Twaron® threads form the first set of threads in the first layer and the Trevira® threads form the fifth set of threads. The second woven layer (second layer) has Twaron® (type 2040, 930 dtex, f1000) in the weft direction and Trevira® (710, 140 dtex, Hoechst) in the warp direction, wherein the Twaron® threads form the second set of threads and the Trevira® threads form the sixth set of threads. A thermoplastic film made from polyethylene film (LDPE) with a thickness of 11 μm is laid between the two woven layers. The Twaron® threads of the first and second woven layers form an angle of 90° with one another. The first woven layer, the second woven layer, and the thermoplastic film between the woven layers form the first component.

To join the first component and the second component, a thermoplastic film made from polyethylene film (LDPE) with a thickness of 11 μm is laid between the first and the second components, thus between the second layer and the third layer. Alternatively thereto, an adhesive grid or an adhesive mesh made from threads coated with adhesive material can be laid between the first and the second component, wherein the joining between the first and the second component is only at discrete points. In addition, a thermoplastic film made from polyethylene film (LDPE) with a thickness of 11 μm is laid on the first layer and under the fourth layer. The first component is laid on the second component, so that the third thread direction is approximately at an angle of +45° to the first thread direction and the fourth thread direction is approximately at an angle of −45° to the first thread direction.

A plurality of combinations thus formed from first and second components with polyethylene films (or adhesive grid, adhesive mesh) are stacked on top of one another, wherein each combination (first and second components) is separated from a subsequent combination by means of separating paper. This is followed by a pressing in a static press at approximately 25 bar at a temperature of 120° to 180° C. for approximately 25 minutes, wherein afterwards the heater on the press is switched off. This melts the thermoplastic film (and potentially the adhesive grid, adhesive mesh). Preferably a single pressing procedure is sufficient to produce a penetration-inhibiting material from the at least four layers with film.

For a penetration-inhibiting material, produced without woven layers, the structure occurs analogously to the variant with woven layers; however, the first layer and the second layer have a first or respectively a second set of threads (Twaron® type 2000, 1100 dtex, f1000 mass per unit area 45 g/m$^2$), which are arranged parallel and unidirectionally within the respective layer. In one embodiment, the first layer is only formed by the first set of threads and the second layer only by the second set of threads. It is also conceivable, however, that the first layer has a fifth set of threads (Twaron® type 2000, 1100 dtex, f1000, mass per unit area 45 g/m$^2$) in addition to the first set of threads, which fifth set of threads lies on top of the first set of threads, wherein the fifth set of threads is oriented transversely to the first set of threads. The fifth and the first sets of threads in this case form a first layer. Further, the second layer can have a sixth set of threads (Twaron® type 2000, 1100 dtex, f1000, mass per unit area 45 g/m$^2$) in addition to the second set of threads, which sixth set of threads lies on top of the second set of threads. The sixth set of threads can run thereby transversely to the second set of threads and form a layer together therewith. In both cases, the second layer is arranged within the penetration-inhibiting material, so that the second thread direction is approximately at a 90° angle to the first thread direction. The first layer and the second layer with the corresponding sets of threads are joined to one another via a matrix material. The first component thus formed in the embodiment has in addition a film on the outer layers. A first component made in this manner is produced for example from Twaron® LFT GF4 from Teijin Aramid. The third layer is arranged within the penetration-inhibiting material, so that the third thread direction is approximately at an angle of +45° to the first thread direction. The fourth layer is arranged within the penetration-inhibiting material, so that the fourth thread direction is approximately at an angle of −45° to the first thread direction.

It is understood that, in one penetration-inhibiting package, a plurality of units of the penetration-inhibiting material according to the invention can be used, made in each case from the first and second components. Further, additional layers can be provided in a package of this type. For example, a penetration-inhibiting package can consist of a plurality of woven layers, as they can be used, for example, for the structure of the first component, and of a plurality of first and second components. It is also conceivable that the arrangement of the first and second components occurs in an alternating pattern, i.e. that initially a combination of first component, second component, and then a combination of second component, first component, are laid on top of one another, wherein the first and second, components of a combination are respectively joined to one another.

The penetration-inhibiting material can be used for example in protective vests, helmets, or penetration-inhibiting plates.

The invention will now be described in more detail by way of the figures and an example.

DETAILED DESCRIPTION OF THE DRAWINGS

Figure 1:
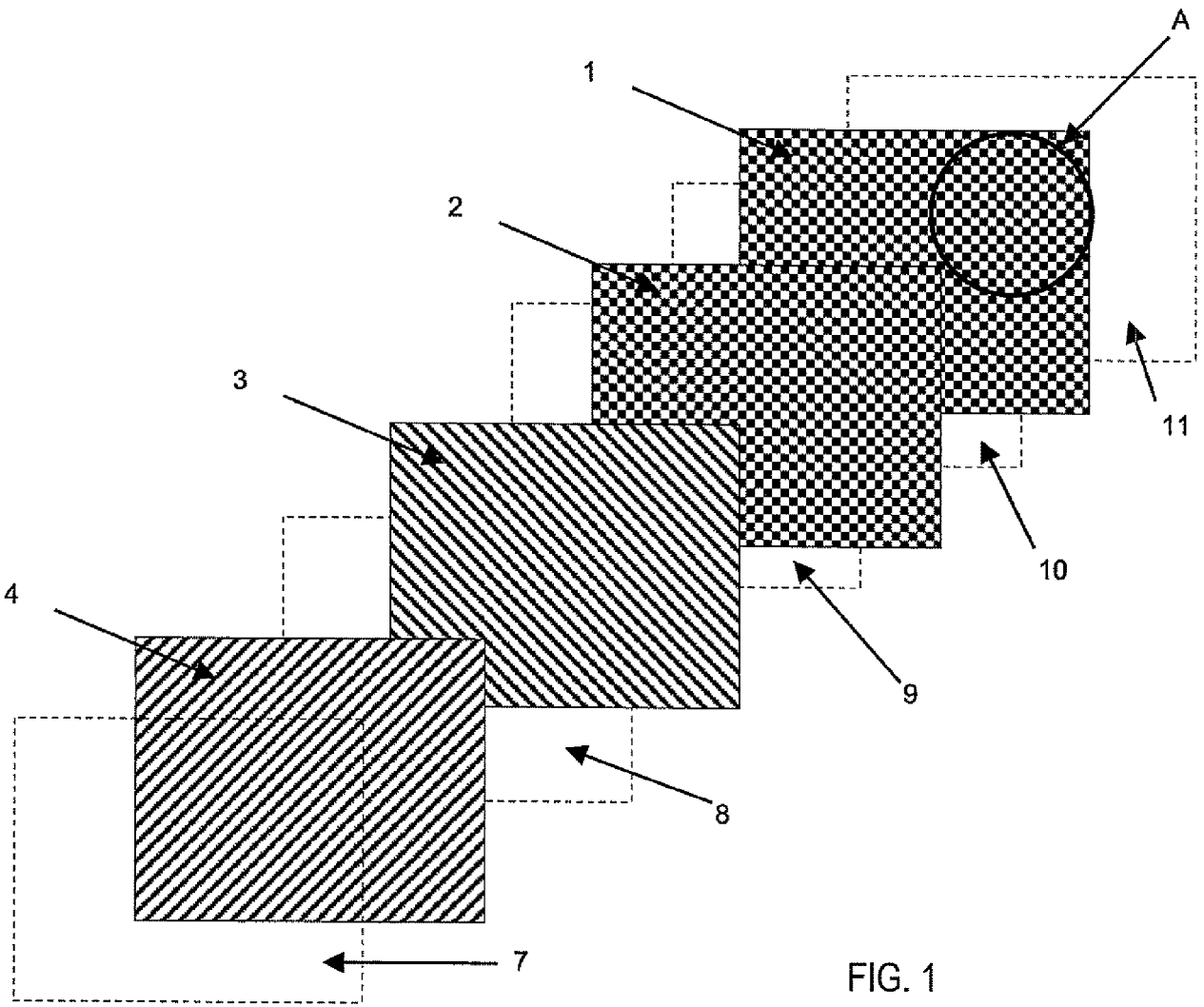
FIG. 1 schematically shows an exploded view of a first embodiment of the penetration-inhibiting material.

FIG. 1 schematically shows an exploded view of a first embodiment of a penetration-inhibiting material. The material consists in the embodiment of a first layer 1, a second layer 2, a third layer 3, and a fourth layer 4. The first and second layers 1,2 form, together with a thermoplastic film 10, a first component of the penetration-inhibiting material. The third and fourth layers 3,4 form, together with a thermoplastic film 8, a first textile binding agent, and stabilizing threads, a second component of the penetration-inhibiting material. In the Example 1 of FIG. 1, the first layer 1 and the second layer 2 consist of a woven fabric. A partial area A of the woven structure is shown enlarged in FIG. 3. The third layer 3 and the fourth layer 4 consist of threads or fibers, arranged unidirectionally parallel with one another within the layers, i.e. the third layer 3 is a thread layer and the fourth layer 4 is a thread layer. The third and fourth layers 3,4 are joined to one another by means of a first textile binding agent (not shown), wherein in the embodiment yet an additional fourth binding agent 8 is used. The fourth binding agent 8 in the embodiment is the thermoplastic film 8. To join the first and second layers 1,2, a second binding agent 10 is used, wherein the second binding agent 10 in the embodiment is the thermoplastic film 10. The first component and the second component of the penetration-inhibiting material are joined to one another by means of a third binding agent 9. The third binding agent 9 can, for example, be a thermoplastic film (for example for a full-surface contact) or an adhesive grid (for discrete contact). In addition, outer layers 7,11 can be provided on the outside of the first layer 1 and the fourth layer 4, wherein each outer layer 7,11 is, for example, a thermoplastic film.

Figure 2:
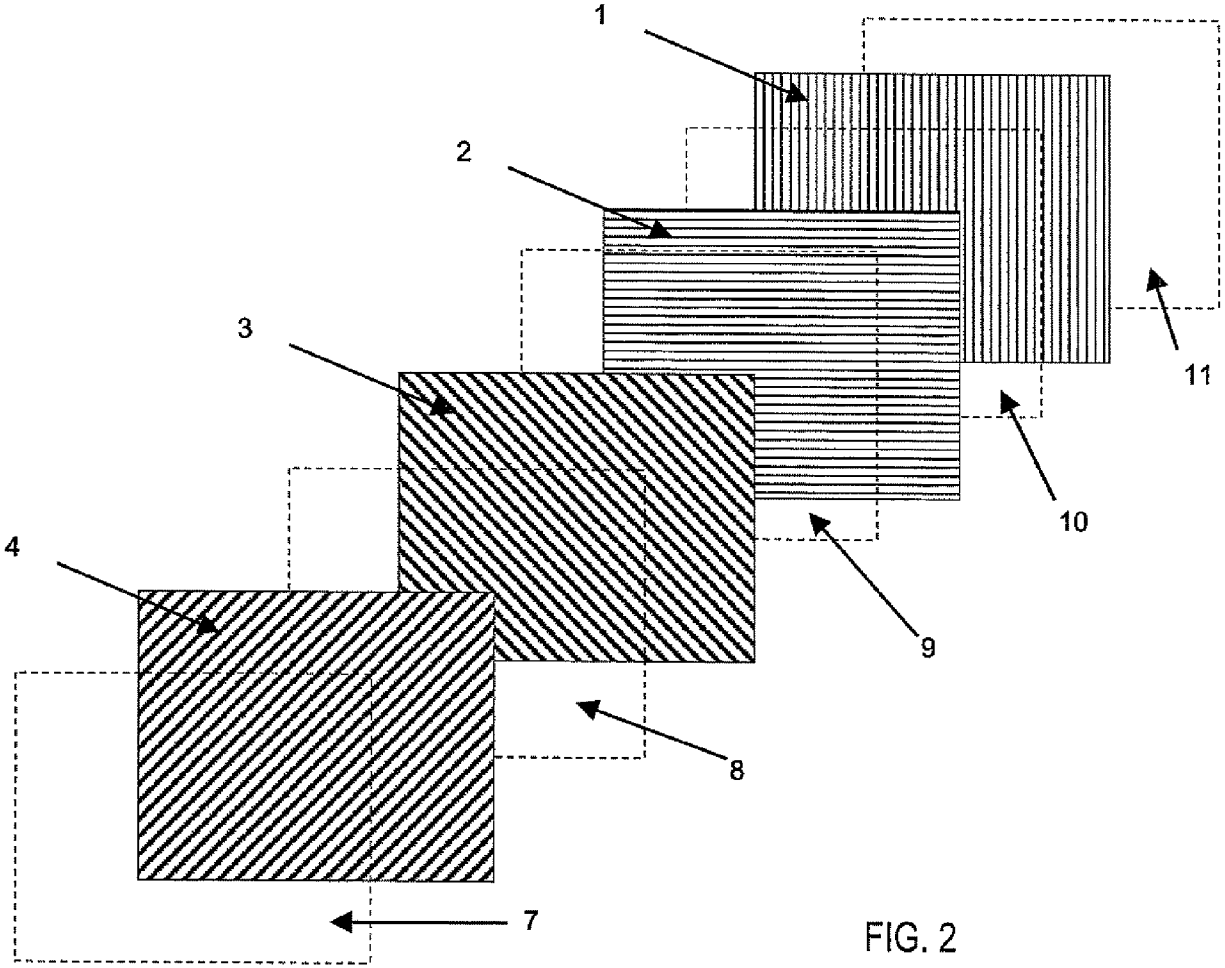
FIG. 2 schematically shows an exploded view of a second embodiment of the penetration-inhibiting material.

FIG. 2 schematically shows an exploded view of a second embodiment of a penetration-inhibiting material. The second embodiment differs from the first embodiment in that no woven fabric is used as the first and second layers 1,2. The first layer 1 is formed by a first set of threads 12 (not labeled in FIG. 2) and the second layer 2 by the second set of threads 13 (not labeled in FIG. 2), wherein the first and second sets of threads 12,13 are formed from fibers or threads. The threads or the fibers of the first and second layers 1,2 run in each layer parallel and unidirectionally to one another. For the penetration-inhibiting material according to FIG. 2, the third layer 3 and the fourth layer 4 are structured the same as in the embodiment of FIG. 1. Also, the use of thermoplastic film as the fourth, second, and third binding agents 8,10,9 as well as the outer layers 11 and 7, is possible in the embodiment according to FIG. 2. In the embodiment of FIG. 1 as well as in the embodiment of FIG. 2, the penetration-inhibiting material can have a plurality of first layers 1, second layers 2, third layers 3, and/or fourth layers 4. Identical layers can also be arranged directly subsequent to one another in the penetration-inhibiting material.

Figure 3:
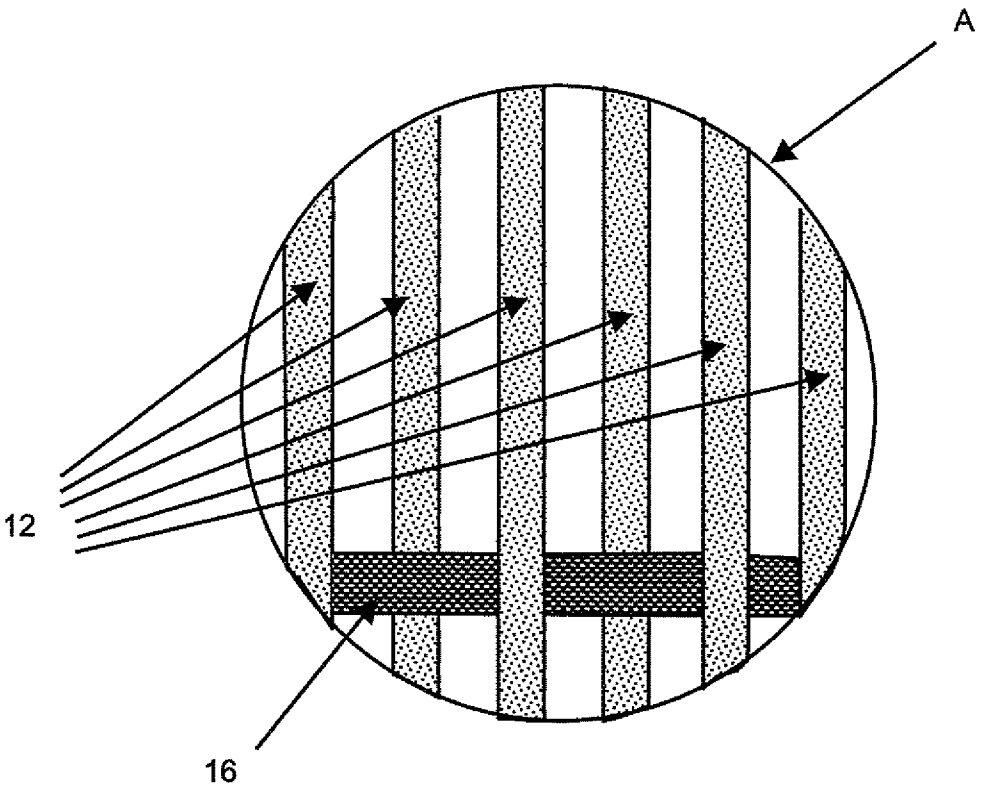
FIG. 3 schematically shows a detailed view from FIG. 1.

FIG. 3 schematically shows a partial area A enlarged from FIG. 1. The partial area A shows a partial area of the woven fabric that forms the first layer 1. The woven layer (or the first layer 1) consists of a first set of threads 12 and a fifth set of threads 16, which are woven together. The first set of threads 12 represents the warp threads of the woven fabric, wherein the warp threads are for example made from fibers or threads made from high-strength aramid. The fifth set of threads 16 represents the weft threads of the woven fabric, wherein for example polyester such as Trevira® can be used as the material for the fifth set of threads 16. In a preferred embodiment of the invention, the second layer 2 is also structured from a woven fabric, wherein the woven fabric has preferably fibers or threads made from high-strength aramid in the weft direction as the second set of threads 13 (shown in FIG. 4). The second layer 2 preferably has polyester threads in the warp direction.

Figure 4:
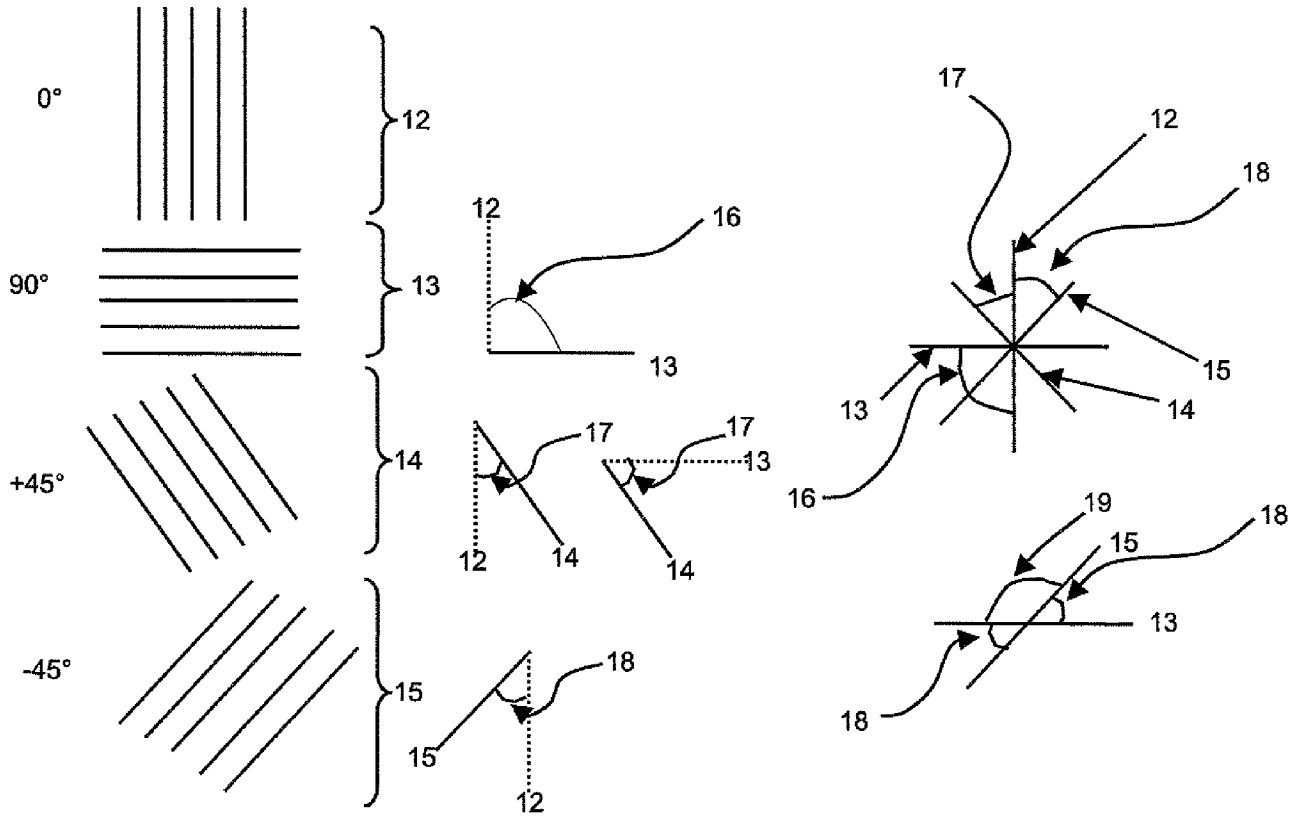
FIG. 4 schematically shows the arrangement of different sets of threads in the penetration-inhibiting material.

FIG. 4 schematically shows which thread directions the sets of threads from the different layers can have relative to one another. In the first layer 1, the first set of threads 12 has a vertical first thread direction) (0°. The second set of threads 13 in the second layer 2 has a second thread direction, which should be essentially perpendicular to the first thread direction) (90°. A third set of threads 14 forms the third layer, wherein the third set of threads is oriented in a third thread direction. The third thread direction is at a first angle 17 to the first thread direction and to the second thread direction. The first angle 17 is preferably 45°. The fourth layer has a fourth set of threads 15 with a fourth thread direction. The fourth thread direction preferably forms with the first thread direction and the second thread direction a second angle 18, wherein the second angle 18 is preferably −45°. The third thread direction and the fourth thread direction preferably form a third angle 16 with one another. The third angle 16 is preferably 90°.

It should be understood that the sign in front of the cited angles only serves to distinguish them. The angles which are formed between the first set of threads 12 and the third set of threads 14, and between the second set of threads 13 and the third set of threads 14, respectively, have the same size. Therefore, only one first angle 17 is discussed. Likewise the angles which are formed between the first set of threads 12 and the fourth set of threads 15, and the second set of threads 13 and the fourth set of threads 15 all have the same size, for which reason only one second angle 18 is discussed.

It should also be clear that the second set of threads 13 includes a further angle 19 with the fourth set of threads 15. Likewise the first set of threads 12 includes a further angle with the fourth set of threads 15, wherein here the sizes of the two angles are also the same, for which reason only one further angle 19 need be discussed. With regard to the further angle, the same statements apply for further possible angles between the first set of threads 12 and the third set of threads 14, and the second set of threads 13 and the third set of threads 14.

Example 1

For Example 1, three different package types were shot at from a distance of 10 meters in each case using 0.357 Magnum (Remington 158 gr.) ammunition Two packages were formed for each package type, and each was shot at eight times. The projectile velocity $v_{2.5}$ (velocity of the projectile between two light barriers, wherein the center of the light barriers was 2.5 m from the muzzle) was 435 m/s for all projectiles. For the bombardment tests, a PE foam layer was arranged on the side of the packages facing away from the impact side. The PE foam layer was 3 mm thick and had a mass per unit area of 100 g/m$^2$. A 40 cm×40 cm Weible plasticine block was arranged behind each package with the foam layer, thus facing away from the impact side. The dent depth in the plasticine block after being shot at was measured to determine trauma. Table 1 lists the average value of the dent depths generated after each of the eight shots per package.

Package Type 1

Each package of package type 1 was formed from nine units. Each unit was constructed as follows:

- thermoplastic film made from polyethylene film (LDPE) with a thickness of 11 μm
- first woven layer (0° direction of the Twaron® threads)
- thermoplastic film (polyethylene film (LDPE), thickness 11 μm)
- second woven layer (90° direction of the Twaron® threads in relation to the 0° direction of the Twaron® threads of the first woven layer)
- thermoplastic film (polyethylene film (LOPE), thickness 11 μm)
- first thread layer (+45° direction of the Twaron® threads in relation to the 0° direction of the Twaron® threads of the first woven layer)
- thermoplastic film (polyethylene film (LOPE), thickness 11 μm)
- second thread layer (−45° direction of the Twaron® threads in relation to the 0° direction of the Twaron® threads of the first woven layer)
- thermoplastic film (polyethylene film (LDPE), thickness 11 μm)

Each woven layer was woven from Twaron® threads (type 2040, 930 dtex, f1000) and Trevira® threads (710, 140 dtex, Hoechst). The woven layers had a 1/1 plain weave. In the first woven layer, the Twaron® threads lie in the warp direction (9.5 threads/cm) and the Trevira® threads (2 threads/cm) lie in the weft direction. In the second woven layer, the Trevira® threads (4 threads/cm) lie in the warp direction and the Twaron® threads (9.5 threads/cm) lie in the weft direction. The first and the second woven layers are arranged in relation to one another, so that the Twaron® threads of the two woven layers form an angle of 90° to one another. The first woven layer, the second woven layer, and the thermoplastic film between the two woven layers together form a first component.

Each of the two thread layers consists of Twaron® threads (type 2040, 930 dtex, f1000, mass per unit area of each layer 96 g/m$^2$) arranged unidirectionally and parallel to one another. The two thread layers were arranged in the packages of the first package type so that the respective Twaron® threads of each thread layer formed an angle of 90°. The two thread layers and the thermoplastic film between the two layers were joined by knitting threads. A textured polyester thread (76 dtex, f24) was used as the knitting thread. In addition, the two thread layers were stabilized by a stabilizing thread (0.1 threads/cm). The stabilizing threads run parallel to the Twaron® threads of the first woven layer (0° direction) and have a distance between one another of approximately 10 cm. Twaron® threads (type 2040, 930 dtex, f1000) were used as the stabilizing threads. The two thread layers were arranged in the packages of the package type 1 so that the Twaron® threads of the thread layers formed an angle of ±45° with the Twaron® threads of the woven layers. The two thread layers, the thermoplastic film between the thread layers, the knitting threads, and the stabilizing threads form a second component.

The nine units were stacked on top of one another, wherein each unit was separated from the next unit by separating paper. The nine units were then pressed on a static press for 25 minutes at 120° C. at a pressure of 25 bar, and finally the heater on the press was switched off. The separating paper prevents the units from being joined to one another.

The pressed units were stacked on top of one another to form the package of the package type 1, so that the Twaron® threads of the first layer always lay in 0° direction. To join the nine units for each package of the package type 1, all nine units were sewn together in the corner areas. Twaron® (type 2000, 840 dtex, f1000 z160) was used as the sewing yarn.

Package Type 2

Comparison Example

Each package of the package type 2 was formed from eighteen second components and additional polyethylene film (LDPE, thickness 11 μm). A polyethylene film was laid on top of and under each second component to be used, wherein here the individual second components (with polyethylene films) were also separated from one another by separating paper. All second components with additional polyethylene films for a package were pressed on a static press for 25 minutes at 120° C. at a pressure of 25 bar, and finally the heater on the press was switched oft The separating paper prevented the second components from being joined to one another. The eighteen parts of the pressed material thus created were stacked on top of one another to form each package of the package type 2, so that the sets of threads of adjacent layers formed an angle of approximately 90° with one another. The eighteen layers laid on top of one another were sewn together in the corner areas. Twaron® (type 2000, 840 dtex, f1000 z160) was used as the sewing yarn.

Package Type 3

Comparison Example

Each package of the package type 3 was formed from eighteen first components. An additional polyethylene film (LDPE, thickness 11 μm) was laid on top of and under each of the first components. All first components with additional polyethylene film (structure) for a package of the package type 3 were stacked on top of one another, wherein the individual structures were separated from one another by separating paper. The pressing took place on a static press for 25 minutes at 120° C. at a pressure of 25 bar, and finally the heater on the press was switched off. For a package of the package type 3, eighteen structures were laid on top of one another, wherein in each case the Twaron® threads of the first layer were oriented in the 0° direction. To form the two packages of the package type 3, all eighteen structures were sewn together in the corner areas. Twaron® (type 2000, 840 dtex, f1000 z160) was used as the sewing yarn.

TABLE 1

| Package Type | Trauma (mm) |
|---|---|
| Package Type 1 | 29 |
| Package Type 2 (Comparison Example) | 38 |
| Package Type 3 (Comparison Example) | 41 |

As can be seen from Table 1, the first package type made from the penetration-inhibiting material according to the invention has a significantly lower trauma (background deformation) than the package types of the comparison examples 2 and 3. The trauma could surprisingly be reduced by approximately 30% using the same number of thread layers and approximately the same package weight of the packages of the first package type in comparison with the packages of the package types two and three. The achievement of this type of improvement based on the combination of two components with different thread layers was surprising and not predictable. An additional advantage of the package type 1 consists in that little waste results during production of the packages of the package type 1. If the packages of package type 1 were produced using only one component, then the first or the second component would have to be rotated by approximately 45° in order to achieve the same thread direction of the four sets of threads in the penetration-inhibiting material, whereby considerable production waste would unnecessarily result.

Example 2

For Example 2, two package types (package type 4 and package type 5), each comprising one package, were shot at six times in each case at a distance of 5 meters using 0.44 magnum JHP bullets (Remington, 240 gr.) according to the NIJ Standard 0101.04 (Class III A), A 3 mm thick PE foam layer was arranged behind each package. A Roma plasticine block was arranged behind the package and foam layer (thus facing away from the impact side) in order to determine the background deformation (trauma). The dent depth in the plasticine block was measured to determine trauma. The projectile velocity was also measured, which is given in Table 2.

Package Type 4

Comparison Example

The package of the package type 4 was formed from 22 first components, wherein a polyethylene film (LDPE, thickness 11 μm) was laid on top of and under each of the first components. The 22 structures thus created were stacked on top of one another, wherein the individual structures (component 1 between two thermoplastic films) were separated from one another by separating paper. The structures were then pressed on a static press for 25 minutes at 120° C. at a pressure of 25 bar, and finally the heater on the press was switched off. The separating paper prevented the 22 structures from being joined to one another by the film. After the pressing, the structures were arranged on top of one another so that the Twaron® threads of adjacent layers had an angle of approximately 90° with one another. Finally the structures were sewn together in the corner regions to form a package of the package type 4. Twaron® (type 2000, 840 dtex, f1000 z160) was used as the sewing yarn. The mass per unit area of the fourth package type was approximately 4900 g/m$^2$.

Package Type 5

Comparison Example

The package of the package type 5 was formed from 11 elements, wherein each element comprised two first components with an additional intermediate thermoplastic film. Each of these 11 elements was structured as follows:

- thermoplastic film made from polyethylene film (LDPE) with a thickness of 11 μm
- first woven layer (0° direction of the Twaron® threads, Trevira® threads lie in the weft direction)
- thermoplastic film (polyethylene film (LOPE), thickness 11 μm)
- second woven layer (90° direction of the Twaron® threads in relation to the 0° direction of the Twaron® threads of the first woven layer)
- thermoplastic film (polyethylene film (LOPE), thickness 11 μm)
- first woven layer (0° direction of the Twaron® threads)
- thermoplastic film (polyethylene film (LOPE), thickness 11 μm)
- second woven layer (90° direction of the Twaron® threads in relation to the 0° direction of the Twaron® threads of the first woven layer)
- thermoplastic film (polyethylene film (LDPE), thickness 11 μm)

The 11 elements were laid on top of one another in a stack, wherein each element was separated from adjacent elements by separating paper. There followed a pressing of the elements in a static press for 25 minutes at 120° C. at a pressure of 25 bar, and finally the heater on the press was switched off. Subsequently, the pressed elements were stacked on top of one another and sewn together in the corner areas, so that the Twaron® threads in layers of adjacent elements had an angle of 90° with one another. Twaron® (type 2000, 840 dtex, f1000 z160) was used as the sewing yarn. The mass per unit area of such a package was approximately 4700 g/m$^2$.

TABLE 2

| | V (m/s) | Trauma (mm) |
|---|---|---|
| Package Type 4 | 442 | 57 |
| | 443 | 52 |
| | 443 | 48 |
| Package Type 5 | 443 | 59 |
| | 442 | 56 |
| | 444 | 56 |

It is clear from Table 2 that the package types 4 and 5 have approximately the same trauma value at the same number of woven layers and approximately the same mass per unit area; even though four woven layers in package type 5 and only two woven layers in package type 4 were joined across the full surface by a thermoplastic film.

Based on the results from Example 1 and Example 2, it is obvious that the good trauma values of the package type 1 is not a result of the joining of the 4 layers with one another, but instead can be ascribed to the selection of the layers and the direction of the layers within the package type 1.

LIST OF REFERENCE NUMERALS

1 first layer
2 second layer
3 third layer
4 fourth layer

7 outer layer
8 fourth binding agent
9 third binding agent
10 second binding agent
11 outer layer
12 first set of threads
13 second set of threads
14 third set of threads
15 fourth set of threads
16 fifth set of threads
17 first angle
18 second angle
19 further angle

The invention claimed is:

1. A penetration-inhibiting material comprising:

at least one first component having at least one first layer with a first set of threads and a second layer with a second set of threads, wherein:

the first set of threads is oriented in a first thread direction, the second set of threads is oriented in a second thread direction, and the first thread direction is transverse to the second thread direction; and at least one second component having at least one third layer and a fourth layer, wherein:

the third layer is a thread layer having a third set of threads, the fourth layer is a thread layer which having a fourth set of threads, the third set of threads is oriented in a third thread direction, the fourth set of threads is oriented in a fourth thread direction, the third thread direction is transverse to the fourth thread direction, the third thread direction forms a first angle to the first thread direction and to the second thread direction, the fourth thread direction forms a second angle to the first thread direction and to the second thread direction, the third set of threads and the fourth set of threads are joined to one another using at least one first binding agent, and the first binding agent is a textile binding agent.

2. A penetration-inhibiting material according to claim 1, wherein the first set of threads and the second set of threads are joined to one another by a second binding agent.

3. A penetration-inhibiting material according to claim 1, wherein the first component and the second component are joined to one another by a third binding agent.

4. A penetration-inhibiting material according claim 1, wherein the third set of threads and the fourth set of threads are joined by a fourth binding agent.

5. A penetration-inhibiting material according to claim 1, wherein the first and/or the second binding agent is at least one thread.

6. A penetration-inhibiting material according to claim 1, wherein the second binding agent and/or the third binding agent and/or the fourth binding agent is an adhesive material.

7. A penetration-inhibiting material according to claim 6, wherein the adhesive material is a thermoplastic, an elastomeric, or a duroplastic material.

8. A penetration-inhibiting material according to claim 5, wherein the at least one thread is a knitting thread.

9. A penetration-inhibiting material according to claim 1, wherein the first layer has an additional fifth set of threads, whereby the fifth set of threads is woven with the first set of threads.

10. A penetration-inhibiting material according to claim 9, wherein the second layer has an additional sixth set of threads, whereby the sixth set of threads is woven with the second set of threads.

11. A penetration-inhibiting material according to claim 1, wherein the first set of threads, the second set of threads, the third set of threads, and the fourth set of threads are selected from fibers made from aramid, polyethylene, polypropylene, and poly-p-phenylenebenzobisoaxazole.

12. A penetration-inhibiting material according to claim 10, wherein the first set of threads, the second set of threads, the third set of threads, and the fourth set of threads have threads with a linear density greater than 200 dtex, and the fifth set of threads and the sixth set of threads have threads with a linear density greater than 50 dtex.

13. A penetration-inhibiting material claim 5, wherein the fifth set of threads is oriented in a fifth thread direction, whereby the fifth thread direction is parallel to the second thread direction.

14. A penetration-inhibiting material claim 10, wherein the sixth set of threads is oriented in a sixth thread direction, whereby the sixth thread direction is parallel to the first thread direction.

15. A penetration-inhibiting material claim 10, wherein the first set of threads, the second set of threads, the third set of threads, and the fourth set of threads consist of aramid threads, and the fifth set of threads and the sixth set of threads consist of polyester threads.

* * * * *

UNITED STATES PATENT AND TRADEMARK OFFICE

CERTIFICATE OF CORRECTION

PATENT NO. : 8,658,270 B2
APPLICATION NO. : 13/126903
DATED : February 25, 2014
INVENTOR(S) : Christian Boettger et al.

It is certified that error appears in the above-identified patent and that said Letters Patent is hereby corrected as shown below:

In the Specification
Column 8, line 29, "direction) (0°.", should read --direction) (0°).--
Column 9, lines 26 and 31 and Column 12, lines 13, 18, and 21, for "(LOPED)", each occurrence, should read --(LDPE)--
Column 11, line 38, "(Class III A),", should read --(Class III A).--

In the Claims
Column 14, line 4, "according claim 1", should read --according to claim 1--
Column 14, line 37, "material claim 5,", should read --material according to claim 9,--
Column 14, lines 41 and 45, for "material claim 10", each occurrence, should read --material according to claim 10--

Signed and Sealed this
First Day of July, 2014

Michelle K. Lee

Michelle K. Lee
*Deputy Director of the United States Patent and Trademark Office*